US006696399B1

(12) United States Patent
Chernin et al.

(10) Patent No.: US 6,696,399 B1
(45) Date of Patent: Feb. 24, 2004

(54) CLEANING COMPOSITION

(75) Inventors: Vladimir Chernin, Green Bay, WI (US); Richard Martens, Green Bay, WI (US); Ronald W. Kubala, Green Bay, WI (US)

(73) Assignee: Cleaning Systems, Inc., DePere, WI (US)

( * ) Notice: Subject to any disclaimer, the term of this patent is extended or adjusted under 35 U.S.C. 154(b) by 0 days.

(21) Appl. No.: 10/271,632

(22) Filed: Oct. 15, 2002

(51) Int. Cl.[7] ..... C11D 17/00

(52) U.S. Cl. ..... 510/241; 510/424; 510/434; 510/436; 510/492

(58) Field of Search ..... 510/241, 434, 510/436, 492, 424; 134/42

(56) References Cited

U.S. PATENT DOCUMENTS 6,281,178 B1 * 8/2001 Ryklin et al. ..... 510/181
6,339,054 B1 * 1/2002 Levitt et al. ..... 510/241
6,350,725 B1 * 2/2002 Levitt et al. ..... 510/189
6,462,010 B1 * 10/2002 Aszman et al. ..... 510/417
2002/0187914 A1 * 12/2002 Massaux et al. ..... 510/417

* cited by examiner

*Primary Examiner*—Necholus Ogden
(74) *Attorney, Agent, or Firm*—Nancy R. Gamburd

(57) ABSTRACT

The present invention provides a low pH microemulsion cleaning composition, with methods for making and using the composition. The composition includes a salt of citric acid; at least one anionic surfactant such as a complex alkyl phosphate ester; at least one nonionic surfactant; a hydrotrope; a glycol ether; 5% to 25% by weight of glycolic acid, citric acid or lactic acid; 2% to 20% by weight of d-limonene, dl-limonene, pine oil, lemon oil, orange oil, grapefruit oil, lime oil, or bergamot oil; and water.

44 Claims, No Drawings

CLEANING COMPOSITION

FIELD OF THE INVENTION

The present invention is related, in general, to detergent compositions, and more particularly, to detergents utilized in transportation applications, such as automobile and truck washing.

BACKGROUND OF THE INVENTION

Detergent compositions are utilized in a wide variety of applications, all having differing requirements, such as detergents for household use, detergents for industrial use, and detergents for vehicle washing and other transportation applications. Household and industrial detergents, for example, are being created to require one application and no rinsing, such as that disclosed in Aszman et al. U.S. Pat. No. 6,462,010, issued Oct. 8, 2002, entitled "All Purpose Liquid Cleaning Compositions Compromising Solubilizers", which illustrates a detergent for typical household use. Such detergents are unsuitable for a vehicle washing environment, in which the components to be removed include oily soils, mineral soils, innumerable types of organic and inorganic matter, mud, tar, grease, oil, and virtually any other item which may be found in a transportation environment, for automobiles, trucks, trains, airplanes, jets, boats, and ships.

Vehicle washing has also evolved from various mechanical systems having physical contact with the vehicle, such as by using brushes and cloths, to non-mechanical washing systems which spray detergent on the vehicle and then rinse with water under high pressure, without the use of brushes, cloths or other mechanical aids. In addition, such non-mechanical systems may also use a two-detergent application washing process in which one detergent is applied, followed by a variable lag or dwell time, followed by application of a second detergent, again followed by a variable lag or dwell time, and then rinsing with high pressure water. In this environment, because of the absence of friction with the soiled surface from a mechanical device, more effective types of detergents are required to achieve comparable cleaning.

In the prior art, in a two-detergent non-mechanical vehicle washing process, the first detergent applied is frequently a low pH detergent containing a mineral acid, such as hydrofluoric acid (HF). These hydrofluoric acid detergents are highly corrosive, both to the vehicle and to the vehicle wash facility, are toxic to consumers and the environment, are dangerous to make, ship, and use, and may be otherwise damaging to a vehicle's surface. In the application of a second detergent, an alkaline detergent is often utilized, containing, for example, sodium hydroxide, potassium hydroxide, or various sodium and potassium silicates, carbonates or phosphates.

A need remains, therefore, for a detergent composition having a low pH, which is noncorrosive and nontoxic, but which is highly effective in a transportation cleaning application. In addition, a need remains for new washing procedures, which are equally effective as these prior art HF processes.

DETAILED DESCRIPTION OF EXEMPLARY EMBODIMENTS OF THE INVENTION

While the present invention is susceptible of embodiment in many different forms, there will be described herein in detail specific embodiments thereof, with the understanding that the present disclosure is to be considered as an exemplification of the principles of the invention and is not intended to limit the invention to the specific embodiments illustrated.

As indicated above, a need exists for a new detergent composition which is highly effective in vehicle and other transportation washing applications, such as automobile washing, but which does not have the corrosive effect and toxicity of the prior art detergents containing hydrofluoric acid or its variants, such as ammonium bifluoride (ABF). In accordance with the present invention, a detergent composition is provided which utilizes an organic acid, such as a hydroxycarboxylic acid, with various surfactants, and with a high concentration of a terpene such as d-limonene. The detergent composition of the invention provides significant and equal effectiveness in vehicle cleaning, without the harmful corrosive and toxic side-effects of hydrofluoric acid-based or other mineral acid-based low pH detergents In addition, the detergent composition of the present invention may be utilized in a two-detergent vehicle washing process, first involving the application of the detergent composition of the invention, followed by a variable dwell time, followed by application of an alkaline detergent, followed by a variable dwell time, and then followed by high pressure water rinsing. The detergent composition of the present invention is especially effective at removing road film, comprised of various oils, mineral soils, innumerable types of organic and inorganic matter, mud, tar, and grease, which common detergents are less effective at removing.

The terms "surface active agent", "detergent", "surfactant" and "emulsifier", as used herein have their ordinary meaning as is well known in the detergent and emulsion arts.

In one aspect, the present invention provides a noncorrosive, nontoxic emulsion for cleaning metals, plastics, glass, rubber, and other materials, such as those materials used in a vehicle, and so, which may be coated or uncoated, such as a painted automobile body, a coated windshield, and an uncoated alloy wheel. The composition contains at least one surface active agent, from 3 % to 30 % of a hydroxycarboxylic acid having a pK of from $10^{-5}$ to $10^{-2.5}$, and from 2% to 50% of a terpene, with all percentages by weight. The surface active agents are a detergent, a surfactant or an emulsifier. In one embodiment, a co-emulsifier is an acid salt such as potassium or sodium citrate. Another surface active agent is a surfactant such as an anionic or nonionic surfactant. Preferably, the emulsion includes a plurality of surface active agents including detergents, surfactants and emulsifiers.

Exemplary and preferred anionic surfactants include a linear C10–C16 alkyl benzene sulfonate, the sodium, potassium, ammonium and ethanolammonium salts of a linear C8–C16 alkyl benzene sulfonate, a C10–C20 paraffin sulfonate, an alpha olefin sulfonate containing about 10–24 carbon atoms, or a C8–C18 ethoxylated alkyl sulfate. (It should be noted that the notation "Cx" as used herein, denotes the number (or range of numbers) of carbon atoms in a chain of the corresponding molecular structure, such as C10–C20 paraffin sulfonates denoting paraffin sulfonates having 10 to 20 carbon atoms in its molecular structure (molecule)).

Exemplary and preferred nonionic surfactants include an ethoxylated C8–C18 alkylphenol, a condensation product of a higher alcohol condensed with about 2 to 14 moles of ethylene oxide. The surface active agent can also be an emulsifier. Such emulsifiers are well known in the art.

The emulsion contains high levels of a terpene. Preferably, the amount of terpene is from 2 weight percent (%) to 40 weight percent (%) or higher. More preferably, the emulsion contains from 3% to 20% terpene and, more preferably from 3% to 10% terpene. Exemplary and preferred terpenes are well known in the art and set forth hereinafter.

The emulsion contains a hydroxycarboxylic having a pK of from $10^{-5}$ to $10^{-2}$. Preferably, the pK of the hydroxycarboxylic is from $10^{-3}$ to $10^{-4}$. The hydroxycarboxylic contains from 2 to 6 carbon atoms and can be linear, branched chain or cyclic. Preferably the hydroxycarboxylic is linear or branched chain and contains from 2 to 4 carbon atoms. Exemplary and preferred such hydroxycarboxylic are glycolic acid, citric acid or lactic acid. The emulsion contains from 2 weight percent (%) to 25 weight percent (%) of the hydroxycarboxylic. The pH of the emulsion is less than 7. Preferably, the pH is from 1.5 to 5. More preferably, the pH is from 1.5 to 4.

The emulsion can include other ingredients such as a hydrotrope, such as sodium xylene sulfonate or similar compounds.

In one preferred embodiment, the low pH, noncorrosive detergent of the present invention comprises, approximately by percentage weight:

(a) 1% to 3% of a co-emulsifier, such as a salt of citric acid, including sodium citrate and potassium citrate;

(b) an anionic surfactant, such as 2% to 8% of an alkyl benzyl sulfonate, as a surface active agent;

(c) a hydrotrope (and emulsifier) such as 0.5% to 5% of sodium xylene sulfonate in a 30% solution or in a powder form, as a surface active agent;

(d) a nonionic surfactant, such as 1.5% to 9% ethoxylated alkyl phenol, as a surface active agent;

(e) a co-solvent, such as 0.5% to 4% glycol ether, such as diethylene glycol monobutyl ether;

(f) an anionic surfactant such as 1.5% to 10% complex alkyl phosphate ester, as a surface active agent;

(g) an organic acid, such as 5% to 25% hydroxycarboxylic acid, such as glycolic acid, citric acid, or lactic acid;

(h) a terpene solvent, such as 2% to 20% d-limonene; and (i) the balance being water.

It will be understood by those of skill in the art that equivalent units of measurements, such as by molarity or molality, may be substituted and are within the scope of the present invention.

It should also be noted that the percentages listed above are for a concentrated solution. It will also be understood by those of skill in the art that the detergent composition of the invention may be diluted to any desired strength, preferably by water, throughout a wide range. The detergent composition of the invention should have, as a minimum, roughly or approximately 30% to 40% (and preferably a minimum of 36%) water by weight to form an emulsion (rather than a gel) (and not including water which may be part of the other ingredients, such as within a 70% glycolic acid solution). In typical applications, the detergent composition of the invention may be diluted in a range extending as much as 200 times (0.5% detergent in water). For example, in a typical automobile wash environment, the concentrated detergent of the present invention may be diluted on a scale of 1 part detergent to 80 parts water, and applied to a vehicle.

The use of an organic acid, such as the family of hydroxycarboxylic acids, including glycolic acid, citric acid and lactic acid, provides a novel method of lowering the pH of the detergent composition, enhancing the effectiveness of the various surfactants, without being corrosive to a washing facility or to a vehicle, and without toxic side effects. The pH range of the detergent composition of the invention should be from 1.5 to 3.5, and preferably from 2 to 2.5. In addition, this use of a hydroxycarboxylic acid allows for use of a high percentage of a terpene such as d-limonene, for increased cleaning effectiveness and maintenance of an emulsion. In contrast, use of other noncorrosive organic acids, or use of-a mineral acid such as the hydrofluoric acid of the prior art, does not allow this significant percentage of terpene to be included, but instead enables only the use of a much lower percentage of d-limonene or other terpenes, with correspondingly decreased detergent performance.

As indicated above, the family of hydroxycarboxylic acids may be utilized in the detergent composition of the present invention. Such acids include glycolic acid, lactic acid, and citric acid, among others. Preferably, a hydroxycarboxylic acid is selected which has six or fewer carbon atoms in its molecular structure, as hydroxycarboxylic acids having more than six to ten carbon atoms have less solubility in water. The preferred pK of the selected hydroxycarboxylic acid should be in the range of $10^{-3}$ to $10^{-4}$ (e.g, glycolic acid (pK of $1.48\times10^{-4}$), lactic acid (pK of $1.38\times10^{-4}$), and citric acid (pK of $8.4\times10^{-4}$)). Depending on the selected hydroxycarboxylic acid, it may have a higher or lower percentage in the detergent composition of the invention, such as a range of 5% to 40%. Extensive experimentation has indicated that organic acids, other than the family of hydroxycarboxylic acids, are unsuitable for vehicle detergent applications, as they provide insufficient acidity or are toxic. These other organic acids, along with mineral acids, do not sustain a microemulsion of a detergent having the high terpene concentration of the present invention. For example, HF-based microemulsion detergents do not support a terpene concentration greater than 1–2%.

The detergent composition of the present invention also utilizes a terpene compound, not merely for providing fragrance of the prior art, but as an effective solvent utilized in the cleaning process. In the various embodiments, the preferred or selected terpene may be one or more of the following terpenes: d-limonene from natural and artificial sources, dl-limonene, pine oil, lemon oil, orange oil, grapefruit oil, lime oil, and bergamot oil.

The anionic sulfonate surfactants which may be used in the detergent of this invention are water soluble and include the sodium, potassium, ammonium and ethanolammonium salts of linear C8–C16 alkyl benzene sulfonates; C10–C20 paraffin sulfonates, alpha olefin sulfonates containing about 10–24 carbon atoms and C8–C18 ethoxylated alkyl sulfates and mixtures thereof. The preferred anionic surfactant is a linear C10–C16 alkyl benzene sulfonate.

The nonionic surfactants used in the instant compositions include ethoxylated C8–C18 alkylphenols or condensation products of higher alcohol condensed with about 2 to 14 moles of ethylene oxide (EO), for example, lauryl or myristyl alcohol condensed with 6 moles of ethylene oxide, tridecanol condensed with about 4 to 10 moles of EO, the condensation product of EO with a cut of coconut fatty alcohols with alkyl chain varying from 10 to about 14 carbon atoms in length and wherein in condensate contains either about 4 moles of EO per mole of total alcohol or about 8 moles of EO per mole of alcohol.

A preferred group of the foregoing nonionic ethoxylated alkylphenols are the Surfonic N ethoxylates (Huntsman Corp.), which are alpha- (alkylphenol) containing about 9–15 carbon atoms, such as nonylphenol condensed with 2–3 moles of ethylene oxide (Surfonic N-31,5) or nonylphenol condensed with 5–5 moles of EO (Surfonic N-40).

Additional satisfactory nonionic surfactants, such as oil soluble alcohol ethylene oxide condensates, are the condensation products of secondary aliphatic alcohol containing 8 to 18 atoms in a straight or branched chain configuration condensed with 2 to 14 moles of EO. Examples of commercially available nonionic surfactants (detergents) of the foregoing type are C11–C15 secondary alcohol condensed with either 3 EO (Tergitol 15-S-3) or 5 EO (Tergitol 15-S-5).

Additional satisfactory nonionic surfactants are the Tomodol ethoxylates (Tomah Products), which are higher aliphatic, primary alcohol containing 12–13 carbon atoms condensed with 2–4 moles of ethylene oxide (Tomodol 23-3), C 12–C15 alcohol condensed with 2–4 moles of EO (Tomodol 25-3), C14–C15 linear primary alcohol condensed with 2–3 moles of ethylene oxide (Tomodol 45-2.25).

The complex alkyl phosphate ester surfactants used in the instant compositions are produced by the reaction of fatty alcohols, ethoxylated alcohols or ethoxylated alkylphenol with two possible phosphating agents: orthophosphoric acid and phosphorus pentoxide. Resulting surfactants are mixtures containing- mainly monoalkyl and dialkyl phosphoric acid esters. Some triesters are also present and they are essentially water insoluble and are considered as nonionic molecules behaving as a polar oil. Commercial phosphate esters are thus mixtures of anionic and nonionic surfactants.

A preferred group of the foregoing complex alkyl phosphate esters are Rhodafac phosphate esters (Rhodia, Inc.), which are a nonylphenol ethoxyphosphate (Rhodafac PE-9), free acid of the complex organic phosphate esters (Rhodafac RA-600), linear alcohol ethoxyphosphate ( Rhodafac L6-36A), branched alcohol ethoxyphosphate (Rhodafac RS-410).

Additional satisfactory alkyl phosphate ester surfactants are the Chemphos phosphate esters (Chemron Corp.), which are aromatic phosphate esters (Chemphos TC-227), DePhos phosphate esters (DeForest Enterprises, Inc.), which are polyoxyethelene phenyl phospate esters, Foamphos phosphate esters (Alzo International, Inc.), which are products of reaction of phosphating agents with ethoxylated C12-alcohol condensed with 3 or 6 moles of ethylene oxide (Foamphos L-3 and L-6) or with nonylphenol condensed with 3–9 moles of ethylene oxide (Foamphos NP-6).

The glycol ether used as a solvent (co-solvent) includes any of the reaction products of ethylene oxide or propylene oxide and some version of alcohol including methanol, ethanol, propanol, butanol, hexanol. These may include any of the following ethylene oxide based materials, for example: ethylene glycol monomethyl ether, ethylene glycol monoethyl ether, ethylene glycol monopropyl ether, ethylene glycol monobutyl ether, ethylene glycol monohexyl ether, ethylene glycol phenyl ether, diethylene glycol methyl ether, diethylene glycol monoethyl ether, diethylene glycol monopropyl ether, diethylene glycol monobutyl ether, diethylene glycol monohexyl ether, triethylene glycol monomethyl ether, triethylene glycol monoethyl ether; and they may include any of the following propylene oxide based materials, also for example: propylene glycol monomethyl ether, propylene glycol monopropyl ether, propylene glycol monobutyl ether, propylene glycol t-butyl ether, propylene glycol phenyl ether, dipropylene glycol monomethyl ether, dipropylene glycol monopropyl ether, dipropylene glycol monobutyl ether, dipropylene glycol dimethyl ether, tripropylene glycol methyl ether, tripropylene glycol n-butyl ether, propylene glycol methyl ether acetate, and dipropylene glycol methyl ether acetate.

As indicated above, the detergent composition of the present invention provides a uniquely high and significant percentage of a terpene, such as d-limonene, for use as a solvent. At such high percentages, such terpenes are difficult to maintain in a microemulsion. As a consequence, the preparation of the microemulsion detergent of the present invention should be performed as follows:

(a) utilizing approximately 30% of the total water fraction to be utilized, 1% to 3% sodium citrate, provided as a powder, is dissolved;

(b) 2% to 8% of an anionic surfactant is added, such as an alkyl benzyl sulfonate;

(c) 0.5% to 5% sodium xylene sulfonate is then added, in either 30% solution or powder form;

(d) 1.5% to 9% ethoxylated alkyl phenol and 0.5% to 4% glycol ether are then added, without regard to order;

(e) 1.5% to 10% of the second anionic surfactant, such as complex alkyl phosphate ester, is added;

(f) 5% to 25% of hydroxycarboxylic acid, such as glycolic acid in a 70% solution, is added;

(g) 2% to 20%, and as high as 40%, of a terpene solvent, such as d-limonene, is added; and (h) the balance of the water fraction (e.g., 70%) is added to form the desired dilution level of the microemulsion detergent composition.

While such order in preparation of the composition was immaterial in the prior art hydrofluoric acid detergents, the detergent composition of the present invention is highly sensitive, with improper ordering resulting in formation of a gel rather than a homogenous and clear microemulsion.

The detergent of the present invention is preferably utilized as part of a two-detergent cleaning process comprising: a first application step of applying the detergent of the present invention, followed by a variable dwell time; followed by a second application step of applying an alkaline detergent, followed by a variable dwell time, and then followed by a high pressure water rinse. Alternatively, the alkaline detergent may be applied in a first step, followed by a variable dwell time; followed by a second application step of applying the detergent composition of the invention, followed by a variable dwell time, and followed by a high pressure water rinse. The duration of application of either the low pH microemulsion detergent composition of the invention or the alkaline detergent, in either the first or second step, referred to as dwell times, may be highly variable, depending on the application, and other factors as described below. Two significant variables include, first, the concentration of the detergents being applied, and second, the ratio between the low pH detergent of the present invention in the first step compared to the alkaline detergent of the second step of the process. Other factors include water temperature, detergent temperature, vehicle surface temperature, water softening, water pressure, types of sprays and nozzles utilized, distance from the sprays, and the gallons per minute of detergent solution applied.

The present invention is also based on the empirical finding that the liquid compositions of the present invention provide improved cleaning performance, especially on cleaning of windshield mask, when used in a two-detergent cleaning process in which this composition is followed by a second cleaning solution with a pH range of 9 to 13. It is possible, although has not been determined in fact, that very effective surfactant products are obtained directly on a vehicle surface after complex alkyl phosphate esters are or may be neutralized with an alkaline solution (in a second step).

More particularly and surprisingly, it has been found that there is a synergistic effect on cleaning performance associated with the use of hydroxycarboxylic acid and complex alkyl phosphate esters, as defined herein. Indeed, the cleaning performance delivered by combining a complex alkyl phosphate ester and hydroxycarboxylic acid, as defined herein, in a liquid composition, is superior to the cleaning performance delivered by, for example, the same composition (i.e., balance of the composition) but substituting a different acid (in lieu of the hydroxycarboxylic acid), for example, phosphoric acid or sulfamic acid, at the same pH level.

In a preferred embodiment of the compositions of the present invention, the complex alkyl phosphate esters as defined herein, and the hydroxycarboxylic acid, as defined herein, are present at a weight ratio of complex alkyl phosphate esters to the hydroxycarboxylic acid of from 1:100 to 100:1, preferably 1:20 to 20:1.

The present invention will be further illustrated by the following examples.

The following compositions were made by mixing the listed ingredients in the listed proportions. All proportions are percentages (%) by weight of the total composition. Excellent cleaning performance was delivered to the vehicle surface with these compositions, both under concentrated (neat) and diluted conditions, e.g., at a dilution ratio of 20:1 to 200:1 (water: composition).

| | Compositions (weight %): | | | | | | | | |
|---|---|---|---|---|---|---|---|---|---|
| | A | B | C | D | E | F | G | H | I |
| Citrate | 2.6 | 2.2 | 1.1 | 0.9 | 2.0 | 2.2 | 1.9 | 1.5 | 0.8 |
| Anionic Surfactant | | | | | | | | | |
| Sodium Hydroxide | 1.6 | 1.4 | 0.7 | — | 1.3 | 1.4 | — | 0.9 | 0.5 |
| Alkylbenzenesulfonicacid | 5.2 | 4.5 | 2.2 | — | 4.1 | 4.4 | — | 3.0 | 1.6 |
| Alpha olefin sulfonate | — | — | — | 2.5 | — | — | 5.0 | — | — |
| Sodium xylene sulfonate | 3.8 | 3.3 | 1.6 | 1.4 | 3.0 | 3.2 | 2.8 | 2.2 | 1.2 |
| Nonionic Surfactant | | | | | | | | | |
| Ethoxylated nonylphenol | 5.1 | 4.4 | — | 1.9 | 4.0 | — | 3.8 | 3.0 | — |
| Ethoxylated secondary alcohol | — | — | 2.1 | — | — | 4.3 | — | — | 1.6 |
| Glycol Ether | | | | | | | | | |
| Ethylene glycol monobutyl ether | 3.0 | 2.6 | 1.3 | — | 2.4 | 2.6 | — | 1.8 | 1.1 |
| Diethylene glycol monobutyl ether | — | — | — | 1.1 | — | — | 2.2 | — | — |
| Complex Alkyl Phospate ester | 7.8 | 6.7 | 3.3 | 2.8 | 6.1 | 6.5 | 5.7 | 4.5 | 2.5 |
| Glycolic Acid | 24 | 20.5 | 10 | — | 18.8 | 20 | 17.5 | 13.8 | — |
| Citric Acid | — | — | — | 8.7 | — | — | — | — | 2.5 |
| d-limonene | 5 | 8 | 5 | 7 | 15 | 10 | 8 | 10 | 7 |
| Water | to 100% | | | | | | | | |

As may be apparent from the discussion above, the present invention provides a highly effective, low pH microemulsion cleaning composition, which is noncorrosive and nontoxic. The microemulsion cleaning composition of the invention may be utilized in a wide variety of applications, such as transportation cleaning applications. The microemulsion cleaning composition may be utilized as a first detergent application of a two-detergent cleaning process in conjunction with an alkaline detergent, or may be utilized as the second detergent application, preceded by an alkaline detergent.

From the foregoing, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. A cleaning composition comprising:

at least anionic;

at least nonionic surfactant;

an emulsifier;

a hydrotrope;

a hydroxycarboxylic acid; and a terpene solvent.

2. The composition of claim 1, wherein the second anionic surfactant comprises:

surfactant of 2% to 8% of an alkyl benzyl sulfonate.

3. The composition of claim 1, wherein the anionic surfactant is a complex alkyl phosphate ester selected from a group comprising compositions produced by a reaction of fatty alcohols, ethoxylated alcohols or ethoxylated alkylphenol, with orthophosphoric acid or with phosphorus pentoxide.

4. The composition of claim 1, wherein the anionic surfactant is a complex alkyl phosphate ester selected from a group comprising:

nonylphenol ethoxyphosphate; free acids of the complex organic phosphate esters; linear alcohol ethoxyphosphate; branched alcohol ethoxyphosphate; aromatic phosphate esters; polyoxyethelene phenyl phosphate esters; and reaction products of phosphating agents with ethoxylated C12-alcohol condensed with 3 to 6 moles of ethylene oxide or with nonylphenol condensed with 3 to 9 moles of ethylene oxide.

5. The composition of claim 1, wherein the at least one anionic surfactant is selected from a group comprising:

linear C10–C16 alkyl benzene sulfonate; sodium, potassium, ammonium and ethanolammonium salts of linear C8–C16 alkyl benzene sulfonates; C10–C20 paraffin sulfonates; C10–C24 alpha olefin sulfonates; and C8–C18 ethoxylated alkyl sulfates.

6. The composition of claim 1, wherein the at least one nonionic surfactant is 1.5% to 9% by weight of ethoxylated alkylphenol.

7. The composition of claim 1, wherein the at least one nonionic surfactant is selected from a group comprising:

ethoxylated C8–C18 alkylphenols; lauryl or myristyl alcohol condensed with ethylene oxide, tridecanol condensed with ethylene oxide; a condensation product of ethylene oxide with coconut fatty alcohols having a C10–C14 alkyl chain; C9–C15 alpha- (alkylphenol); nonylphenol condensed with 2–3 moles of ethylene oxide; nonylphenol condensed with 4–5 moles of ethylene oxide; oil soluble alcohol ethylene oxide condensates; and condensation products of secondary C8–C18 aliphatic alcohol in a straight or branched chain configuration condensed with 2 to 14 moles of ethylene oxide.

8. The composition of claim 1, wherein the emulsifier is 1% to 3% by weight of sodium citrate or potassium citrate.

9. The composition of claim 1, wherein the hydrotrope is 0.5% to 5% by weight of sodium xylene sulfonate, adjusted for liquid or powder form.

10. The composition of claim 1, wherein the hydroxycarboxylic acid is one or more of the following acids, 5% to 25% by weight: glycolic acid; citric acid; or lactic acid.

11. The composition of claim 1, wherein the terpene solvent is 2% to 20% by weight of d-limonene, dl-limonene, pine oil, lemon oil, orange oil, grapefruit oil, lime oil, or bergamot oil.

12. The composition of claim 1, further comprising 0.5% to 4% by weight of glycol ether.

13. The composition of claim 12, wherein the glycol ether is selected from a group comprising:

ethylene glycol monomethyl ether, ethylene glycol monoethyl ether, ethylene glycol monopropyl ether, ethylene glycol monobutyl ether, ethylene glycol monohexyl ether, ethylene glycol phenyl ether, diethylene glycol methyl ether, diethylene glycol monoethyl ether, diethylene glycol monopropyl ether, diethylene glycol monobutyl ether, diethylene glycol monohexyl ether, triethylene glycol monomethyl ether, triethylene glycol monoethyl ether; and they may include any of the following propylene oxide based materials, also for example: propylene glycol monomethyl ether, propylene glycol monopropyl ether, propylene glycol monobutyl ether, propylene glycol t-butyl ether, propylene glycol phenyl ether, dipropylene glycol monomethyl ether, dipropylene glycol monopropyl ether, dipropylene glycol monobutyl ether, dipropylene glycol dimethyl ether, tripropylene glycol methyl ether, tripropylene glycol n-butyl ether, propylene glycol methyl ether acetate, and dipropylene glycol methyl ether acetate.

14. The composition of claim 1, wherein the composition is used for vehicle washing.

15. A microemulsion cleaning composition comprising

1% to 3% by weight of sodium citrate;

0.5% to 1.5% by weight of sodium hydroxide;

1.5% to 6% by weight of dodecylbenzenesulfonic aid;

0.5% to 5% by weight of sodium xylene sulfonate;

1.5% to 9% by weight of ethoxylated alkylphenol;

0.5% to 4% by weight of glycol ether;

1.5% to 10% by weight of complex alkyl phosphate ester;

5% to 25% by weight of a glycolic acid;

2% to 20% by weight of d-limonene; and the balance being water.

16. A method of making a microemulsion cleaning composition, the method comprising:

dissolving 1% to 3% by weight of sodium citrate in a 30% by weight water fraction;

adding 0.5% to 1.5% by weight of sodium hydroxide and 1.5% to 6% by weight of dodecylbenzenesulfonic acid;

adding 0.5% to 5% by weight of sodium xylene sulfonate;

adding 1.5% to 9% by weight of ethoxylated alkylphenol and 0.5% to 4% by weight of glycol ether;

adding 1.5% to 10% by weight of complex alkyl phosphate ester;

adding 5% to 25% by weight of a glycolic acid;

adding 2% to 20% by weight of d-limonene; and adding the balance of the water fraction.

17. A method of cleaning comprising:

applying a first event followed by a first variable dwell time, the first detergent comprising at least two anionic surfactant; at least one nonionic surfactant; an emulsifier; a hydrotrope; a hydroxycarboxylic acid; a terpene solvent; and water;

applying a second detergent, followed by a second variable dwell time, followed by rinsing with high pressure water, wherein the second detergent is an alkaline detergent.

18. The method of claim 17, wherein the 2nd anionic surfactant comprises:

anionic surfactant of 0.5% to 1.5% by weight of sodium hydroxide and 1.5% to 6% by weight of dodecylbenzenesulfonic acid.

19. The method of claim 17, wherein the at least one nonionic surfactant is 1.5% to 9% by weight of ethoxylated alkylphenol.

20. The method of claim 17, wherein the emulsifier is 1% to 3% by weight of sodium citrate or potassium citrate.

21. The method of claim 17, wherein the hydrotrope is 0.5% to 5% by weight of sodium xylene sulfonate, adjusted for liquid or powder form.

22. The method of claim 17, wherein the hydroxycarboxylic acid is one or more of the following acids, 5% to 25% by weight: glycolic acid; citric acid; or lactic acid.

23. The method of claim 17, wherein the hydroxycarboxylic acid is 5% to 25% by weight of glycolic acid.

24. The method of claim 17, wherein the terpene solvent is 2% to 20% by weight of d-limonene.

25. The method of claim 17, wherein the terpene solvent is 2% to 20% by weight of d-limonene, dl-limonene, pine oil, lemon oil, orange oil, grapefruit oil, lime oil, or bergamot oil.

26. The method of claim 18, wherein the first detergent further comprises 0.5% to 4% by weight of glycol ether.

27. The method of claim 17, wherein the method is used for vehicle washing.

28. A microemulsion cleaning composition comprising:

a salt of citric acid;

at least;

at least one nonionic surfactant;

a hydrotrope;

a glycol ether;

5% to 25% by weight of glycolic acid, citric acid or lactic acid;

2% to 20% by weight of d-limonene, dl-limonene, pine oil, lemon oil, orange oil, grapefruit oil, lime oil, or bergamot oil; and water.

29. A noncorrosive, nontoxic micro emulsion for cleaning, the composition comprising at least one surface active agent, from 3 % to 30 % of a hydroxycarboxylic having a pK of from $10^{-5}$ to $10^{-2.5}$ and from 2% to 50% of a terpene.

30. The emulsion of claim 29, further comprising sodium citrate.

31. The emulsion of claim 29 wherein the anionic surfactant is a linear C10–C16 alkyl benzene sulfonate, the sodium, potassium, ammonium and ethanolammonium salts of a linear C8–C16 alkyl benzene sulfonate, a C10–C20 paraffin sulfonate, an alpha olefin sulfonate containing about 10–24 carbon atoms, or a C8–C18 ethoxylated alkyl sulfate.

32. The emulsion of claim 29 wherein the surfactant is a nonionic surfactant.

33. The emulsion of claim 32 wherein the nonionic surfactant is an ethoxylated C8–C18 alkylphenol, or a condensation product of a higher alcohol condensed with about 2 to 14 moles of ethylene oxide.

34. The emulsion of claim 29 wherein at least one of the surface active agents is an emulsifier.

35. The emulsion of claim 29 that contains a plurality of surface active agents.

36. The emulsion of claim 29 that contains from 2% to 20% of a terpene.

37. The emulsion of claim 29 that contains from 4% to 6% of a terpene.

38. The emulsion of claim 29 wherein the terpene is d-limonene.

39. The emulsion of claim 29 wherein the hydroxycarboxylic is a linear hydroxycarboxylic containing from 2 to 6 carbon atoms.

40. The emulsion of claim 39 wherein the hydroxycarboxylic is glycolic acid, citric acid or lactic acid.

41. The emulsion of claim 29 wherein the pH is from 1 to 5.

42. The emulsion of claim 41 wherein the pH is from 2 to 4.

43. The emulsion of claim 29 that further comprises a hydrotrope.

44. The emulsion of claim 29 that further comprises a complex alkyl phosphate ester selected from a group comprising compositions produced by a reaction of fatty alcohols, ethoxylated alcohols or ethoxylated alkylphenol, with orthophosphoric acid or with phosphorus pentoxide.

* * * * *

UNITED STATES PATENT AND TRADEMARK OFFICE

CERTIFICATE OF CORRECTION

PATENT NO. : 6,696,399 B1
DATED : February 24, 2004
INVENTOR(S) : Chernin et al.

It is certified that error appears in the above-identified patent and that said Letters Patent is hereby corrected as shown below:

Column 8,
Line 2, please cancel beginning with "1. A cleaning composition" to and including "terpene solvent." and insert the following claim:

1. A microemulsion cleaning composition comprising:

at least two anionic surfactants, wherein one of the anionic surfactants is a complex alkyl phosphate ester in the amount of 1.5 to 10% by weight;

at least one nonionic surfactant;

an emulsifier;

a hydrotrope;

a hydroxycarboxylic acid; and a terpene solvent.

Line 12, after the word "comprises" please delete "surfactant of".
Line 13, after the word "wherein" please delete "the anionic surfactant" and insert -- one of the anionic surfactants --.
Line 19, after the word "wherein" please delete "the anionic surfactant" and insert -- one of the anionic surfactants --.
Line 54, after the word "wherein" please delete "the at least one anionic surfactant" and insert -- one of the anionic surfactants --.

Column 10,
Line 10, please cancel beginning with "17. A method of cleaning" to and including" alkaline detergent." and insert the following claim:

17. A method of cleaning comprising:

applying a first microemulsion detergent followed by a first variable dwell time, the first microemulsion detergent comprising at least two anionic surfactants wherein one of the surfactants is a complex alkyl phosphate ester in the amount of 1.5 to 10% by weight; at least one nonionic surfactant; an emulsifier; a hydrotrope; a hydroxycarboxylic acid; a terpene solvent; and water;

applying a second microemulsion detergent, followed by a second variable dwell time, followed by rinsing with high pressure water, wherein the second detergent is an alkaline detergent.

Line 20, after the words "wherein the" please delete "2nd" and insert -- second --.

UNITED STATES PATENT AND TRADEMARK OFFICE

CERTIFICATE OF CORRECTION

PATENT NO. : 6,696,399 B1
DATED : February 24, 2004
INVENTOR(S) : Chernin et al.

It is certified that error appears in the above-identified patent and that said Letters Patent is hereby corrected as shown below:

Column 10, cont'd.,
Line 48, please cancel beginning with "28. A microemulsion cleaning composition" to and including "and water." and insert the following claim:

28. A microemulsion cleaning composition comprising:

a salt of citric acid;

at least two anionic surfactants, wherein one of the anionic surfactants is a complex alkyl phosphate ester in the amount of 1.5 to 10% by weight;

at least one nonionic surfactant;

a hydrotrope;

a glycol ether;

5% to 25% by weight of glycolic acid, citric acid or lactic acid;

2% to 20% by weight of d-limonene, dl-limonene, pine oil, lemon oil, orange oil, grapefruit oil, lime oil, or bergamot oil; and water.

---

Line 61, please cancel beginning with "29. A noncorrosive, nontoxic" to and including "a terpene." and insert the following claim:

29. A noncorrosive, nontoxic microemulsion for cleaning, the composition comprising at least two surface active agents, wherein one of the surface active agents is a complex alkyl phosphate ester in the amount of 1.5 to 10% by weight from 3 % to 30 % of a hydroxycarboxylic having a pK of from $10^{-5}$ to $10^{-2.5}$ and from 2% to 50% of a terpene.

---

Line 66, after the word "The" please delete "emulsion" and insert -- microemulsion --.

Column 11,
Lines 1, 7, 9, 13, 15, 17 and 19, after the word "The" please delete "emulsion" and insert -- microemulsion --.
Line 1, after the word "wherein" please delete "the anionic surfactant" and insert -- a second surface active agent is an anionic surfactant and --.

UNITED STATES PATENT AND TRADEMARK OFFICE

CERTIFICATE OF CORRECTION

PATENT NO. : 6,696,399 B1
DATED : February 24, 2004
INVENTOR(S) : Chernin et al.

It is certified that error appears in the above-identified patent and that said Letters Patent is hereby corrected as shown below:

Column 11, cont'd.,
Line 7, after the word "claim" please delete "29 wherein the surfactant is" and insert -- 30 further comprising --.

Column 12,
Lines 1, 3, 6, 8, 10, 12 and 14, after the word "The" please delete "emulsion" and insert -- microemulsion --.

Signed and Sealed this

Seventh Day of September, 2004

JON W. DUDAS
*Director of the United States Patent and Trademark Office*